US006079595A

United States Patent [19]

Meyer et al.

[11] Patent Number: 6,079,595

[45] Date of Patent: Jun. 27, 2000

[54] CHEMICAL SOLUTION DISPENSER

[75] Inventors: Christopher A. Meyer, Cottage Grove; Dennis R. Breining, St. Paul; Tammy A. Bailey, Hastings; Todd W. Heeringa, St. Paul; James R. Johnson, Bloomington, all of Minn.

[73] Assignee: Ecolab Inc., St. Paul, Minn.

[21] Appl. No.: 09/289,629

[22] Filed: Apr. 12, 1999

[51] Int. Cl.[7] ..... B67D 5/06

[52] U.S. Cl. ..... 222/181.3; 222/416; 211/112

[58] Field of Search ..... 222/180, 181.1, 222/181.2, 181.3, 185.1, 416; 211/87, 112

[56] References Cited

U.S. PATENT DOCUMENTS

| | | | |
|---|---|---|---|
| 4,146,156 | 3/1979 | Cassia | 222/181 |
| 5,033,649 | 7/1991 | Copeland et al. | 222/132 |
| 5,389,344 | 2/1995 | Copeland et al. | 422/264 |
| 5,897,031 | 4/1999 | Wirt et al. | 222/181.3 |

*Primary Examiner*—Steven O. Douglas
*Attorney, Agent, or Firm*—Mau & Krull, P.A.

[57] ABSTRACT

A liquid dispenser 10 includes a container 20 mounted on a wire rack 40 which is mounted to a wall 60 or the like. An aspirator 80 is mounted on the wire rack and the container covers/conceals the aspirator from view and acts as both a container and cover or shroud.

17 Claims, 5 Drawing Sheets

CHEMICAL SOLUTION DISPENSER

BACKGROUND OF THE INVENTION

1. Field of the Invention

This invention relates generally to a dispenser for dispensing a chemical product, and more particularly to a dispenser that utilizes the container holding the chemical to be dispensed as both a container and shroud or cover.

2. Description of the Prior Art

In janitorial settings which require a significant amount and number of specialized cleaning solutions, the liquid cleaning products are purchased on a concentrated basis, and then are diluted to the proper strength at the site where they will be used. This type of general system is employed by a wide variety of users, e.g., hotels, hospitals, restaurants, etc. Several dispensing systems have been developed for mixing and diluting the concentrated cleaning products. The dispensers usually feature at least some of the following components: a container for the concentrated cleaning product, a housing or cover, a method to dilute the concentrate, and a water supply line.

An aspirator is employed with many dispensing systems to withdraw the concentrated cleaning solution from its container. A water supply line is connected to the aspirator which is located outside of the storage container in a variety of places. In order to provide a more pleasing appearance, the aspirator and concentrate container are covered by a shroud or cover. The cover hides from view the container and aspirator. One would typically only see the water line input and the chemical solution output line. The cover or shroud would hide the rest from view and provide an aesthetically pleasing appearance. Providing an inexpensive dispenser to the wide variety of users previously mentioned is an important factor. The use of a cover or shroud increases; the costs of the dispenser without adding to its functionality. The present invention addresses the problems associated with the currently available dispensing system and provides for an economic dispenser which utilizes the concentrate container in a dual function.

SUMMARY OF THE INVENTION

The invention is a liquid dispenser for attachment to a wall or the like for dispensing a liquid. The dispenser includes a wire rack for mounting on a wall. An aspirator is mounted on the wire rack. The aspirator has an inlet, outlet and a pickup tube opening. A pickup tube has a first end operatively connected to the aspirator and a second end. A container has an outlet. The outlet is operatively connected to the second end of the pickup tube. The container is mounted on the wire rack. The container has an outer wall and an inner wall. The inner wall is positioned toward the wall and has an indentation. The aspirator is positioned in the indentation to hide it from view.

In another embodiment, the invention is a liquid dispenser for attachment to a wall or the like for dispensing a liquid. The dispenser includes a frame for mounting on a wall. An aspirator is releasably connected to the frame. The aspirator has an inlet, outlet and a pickup tube opening. The dispenser also includes a pickup tube which has a first end operatively connected to the aspirator and a second end. The container has an outlet, the outlet is operatively connected to the second end of the pickup tube. The container is mounted on the frame. The container has an outer wall and an inner wall. The inner wall is positioned toward the wall. The inner wall has an indentation. The aspirator is positioned in the indentation, wherein the container functions as both as a reservoir for the liquid and a cover for the dispenser.

In another embodiment, the invention is a liquid dispenser for attachment to a wall or the like for dispensing a liquid. The dispenser includes a frame for mounting on a wall. An aspirator is releasably connected to the frame. The aspirator has a distal edge. The aspirator also has an inlet, outlet and a pickup tube. The dispenser also includes a pickup tube which has a first end operatively connected to the aspirator and a second end. The container has an outlet, the outlet is operatively connected to the second end of the pickup tube. The container is mounted on the frame. The container has a front wall operatively connected to a rear wall by a side wall. The rear wall has a positioning section. The aspirator is positioned proximate the positioning section, wherein a distance from the front wall to the side wall's end is greater than the distance from the front wall to the distal edge of the aspirator.

DETAILED DESCRIPTION OF THE PREFERRED EMBODIMENT

Figure 8:
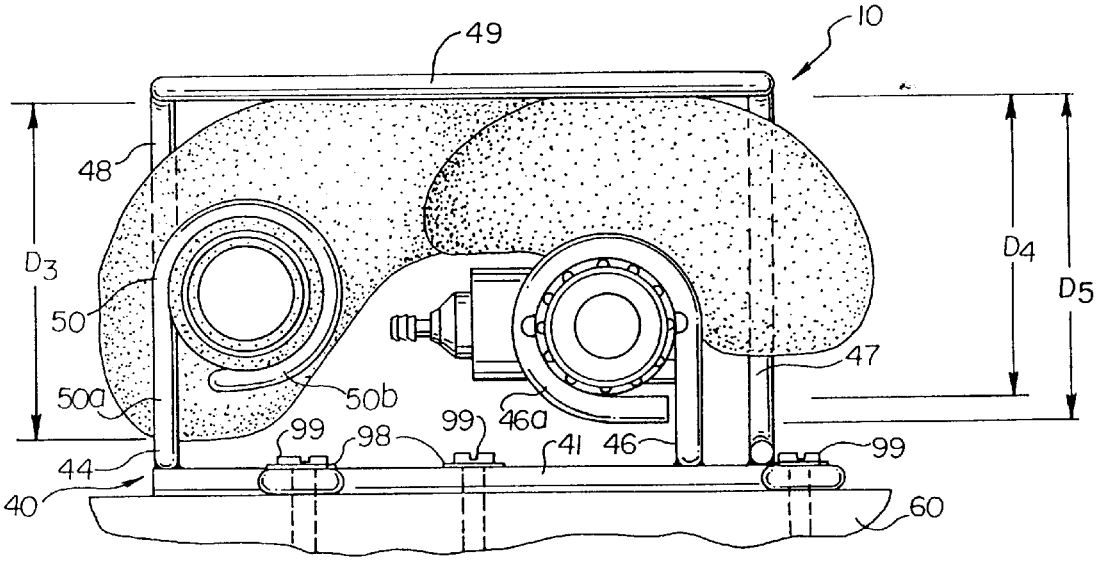
FIG. 8 is a top plan view of the dispenser system of the present invention.
Figure 9:
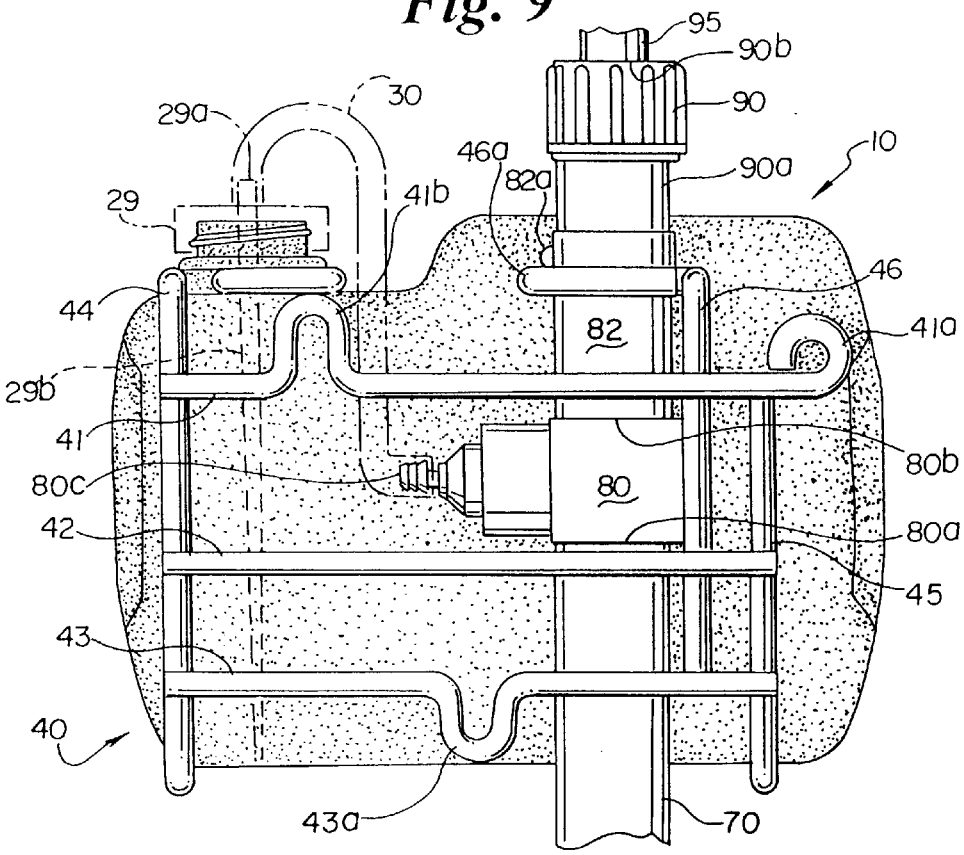
FIG. 9 is a rear elevational view of the dispenser system shown in FIG. 8.

Referring to the drawing, wherein like numerals represent like parts throughout the several views, there is shown in FIGS. 8 and 9 a liquid dispenser, generally designated at 10. The liquid dispenser 10 includes a container 20 which is removably connected to a wire rack 40, the wire rack 40 is in turn mounted on a wall 60 or the like.

Figure 1:
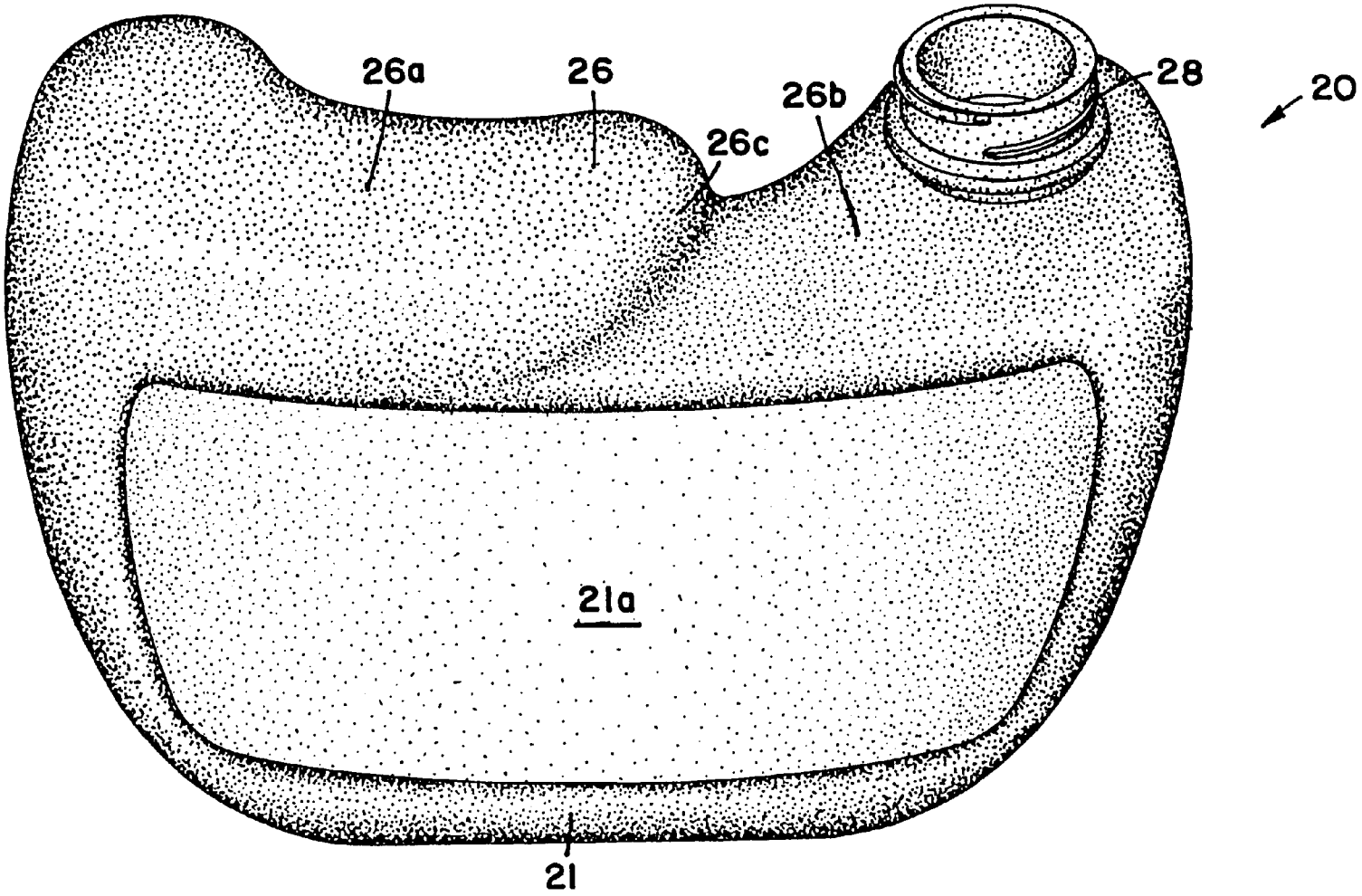
FIG. 1 is a perspective view of a container.
Figure 2:
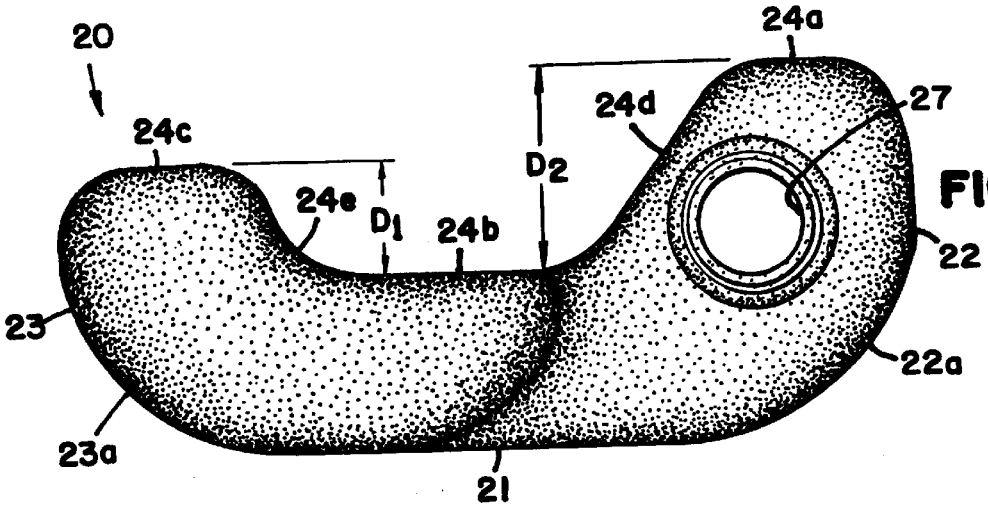
FIG. 2 is a top view of the container.
Figure 3:
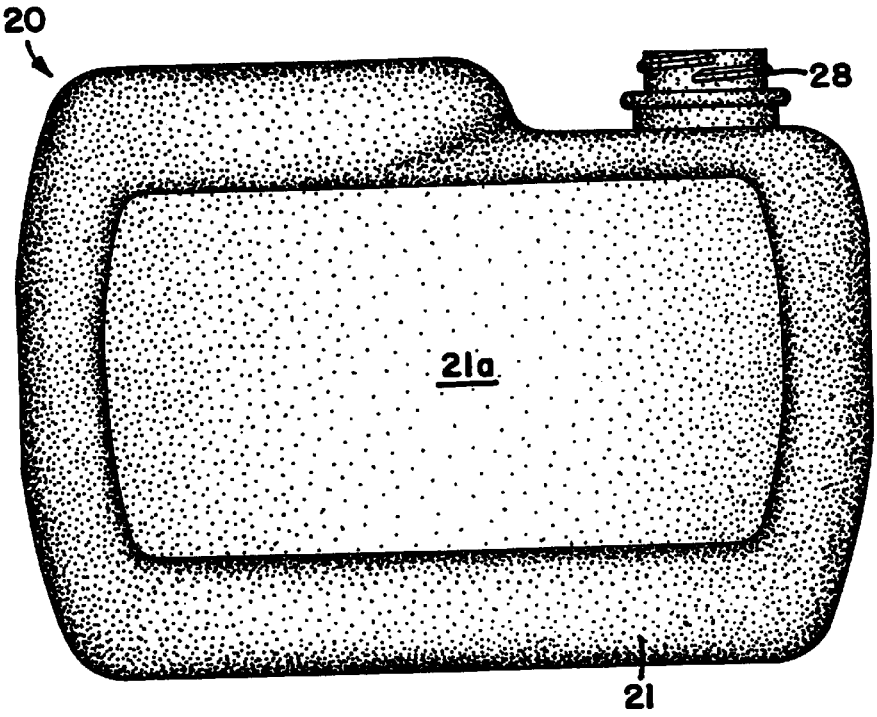
FIG. 3 is a front elevational view of the container.
Figure 4:
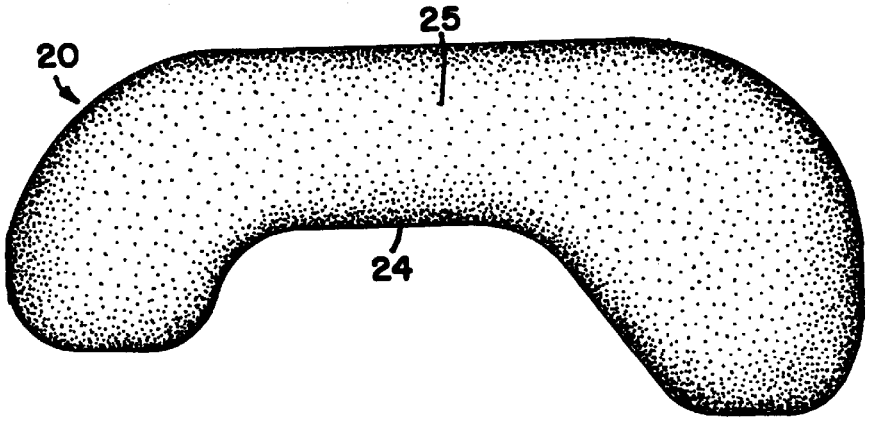
FIG. 4 is a bottom elevational view of the container.
Figure 5:
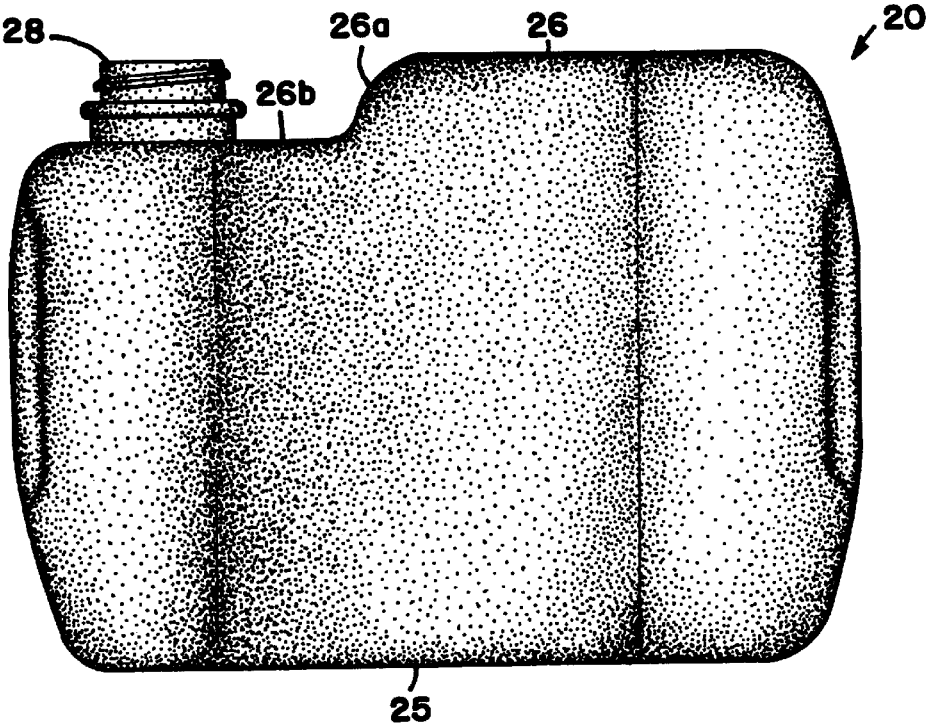
FIG. 5 is a rear elevational view of the container.
Figure 6:
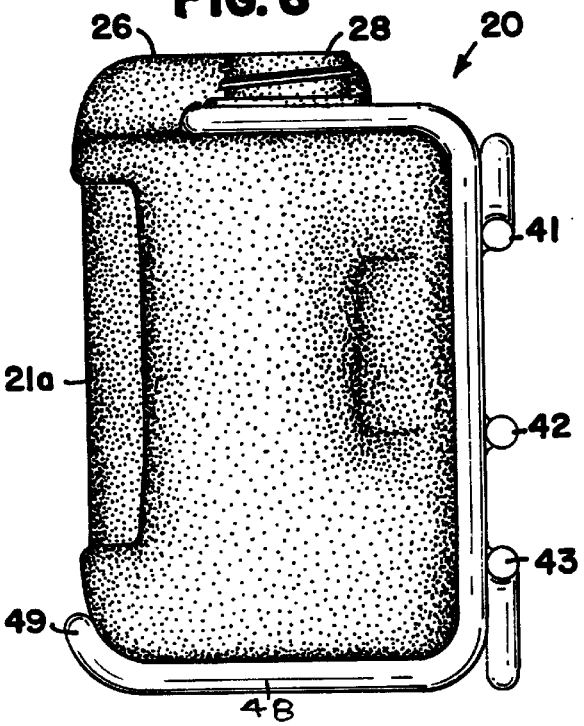
FIG. 6 is a right side elevational view of the container shown in a wire rack.
Figure 7:
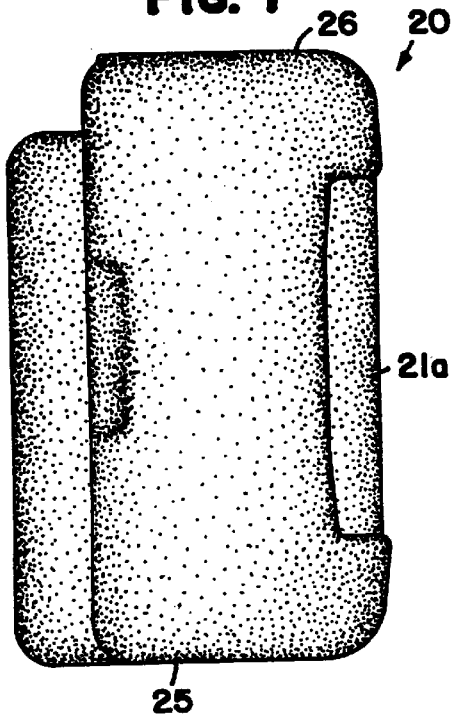
FIG. 7 is a left side elevational view of the container.

The container 20 is shown in detail in FIGS. 1 through 7. The container 20, when viewed from the front, has a generally rectangular profile. When viewed from above and below, as seen in FIGS. 2 and 4, the shape is generally concave. The container 20 has a front wall 21 which is generally rectangular at its center section and is rounded slightly toward the back at its edges. An indented area 21 a is formed for the placement of a suitable label. The right side wall 22 is connected to the front wall 21 by a curved portion 22*a*. The left side wall 23 is connected to the front wall 21 by curved portion 23*a*. The rear wall 24 has three generally planar sections 24*a*, 24*b*, and 24*c*. Section 24*a* is connected to section 24*b* by means of intermediate section 24*d*. The planar section 24*b* is connected to the planar section 24*c* by arcuate portion 24*e*. A bottom wall 25 is connected to the front wall 21, rear wall 24, right side wall 22, and left side wall 23. The top 26 has a first section 26*a* connected to a second section 26*b* by intermediate section 26*c*. The second section 26*b* is at a lower height than the first section 26*a*. Formed in the second section 26*b* is an opening 27. A threaded neck 28 is formed in the top section 26*b* around the opening 27 and provides for the receipt of a closure cap 29. The walls of the container 20 form a reservoir for holding the liquid product which is to be dispensed. The container 20 may be made of any suitable material such as a high-density polyethylene. It is understood other suitable materials may be utilized. Further, the container 20 is preferably formed by blow molding, although other methods may also be utilized.

The rear wall 24 of the container 20 forms an indentation. The distance D1 from the section 24*b* to section 24*c* is approximately 1¼ inches. The distance D2 from the section 24*b* to the section 24*a* is approximately 2¼ inches. In other embodiments, the section 24*c* may be at an elevation equal to the section 24*a*. However, when using blow molding to form the container 20, it was found to be difficult to push enough plastic into that area of the mold without having the container be too thick in the middle section. Accordingly, the section 24*c* does not extend rearwardly as far as section 24*a*. However, as will be discussed more fully hereafter, the indentation formed in sufficient to substantially hide the aspirator from view and would necessarily depend on the size of the aspirator. Further, it is recognized that only one side wall may extend rearward, beyond the second section 24*b*.

The wire rack, generally designated at 40, is adapted and configured to support an aspirator 80 and the container 20. Further, the wire rack 40 is suitable for support on a wall or the like. It is understood that other suitable frames or support besides a wire rack 40 may be utilized. However, it has been found that the wire rack support 40 provides an economical and efficient support and is easy to mount to a wall surface.

The wire rack 40 has a top cross member 41, middle cross member 42 and bottom cross member 43 operatively connected between first and second vertical members 44 and 45. The top cross member 41 has a circular loop 41*a* formed at one end. Further, a slot is formed by a loop section 41*b* proximate the first vertical member 44. The bottom cross member 43 has a loop section 43*a* which forms a slot. The loops 41*a*, 41*b* and 43*a* are utilized to secure the wire rack 40 to a wall. As shown in FIG. 8, screws 99 and washers 98 are inserted in the loop sections and screwed into the wall 60. The head of the screws 99 and washers 98 are larger than the openings formed in the cross members 41 and 43 and therefore hold the wire rack in position on the wall 60.

A first bottom support member 48 has its first end operatively connected to the first vertical member 44 and extends generally horizontally. A second bottom support member 47 has its first end operatively connected to the second vertical member 45 and extends generally horizontal to form a support surface. The second ends of the bottom supports 47 and 48 are connected by a retaining member 49. The retaining member 49 runs generally parallel to the cross members 41 through 43. However, the retaining member 49 is at an elevation slightly higher than the supports 47 and 48 to form a lip to assist in retaining the container 20. A neck-engaging member 50 has its First end operatively connected to the top of the first vertical member 44 and extends generally horizontally. The member 50 has a generally straight section 50*a* connected to an open loop portion 50*b*. The open loop portion 50*b* is sized to be positioned around the threaded neck 28. The end of the open loop portion 50*b* may be deformed outward to allow for positioning of the threaded neck 28. Then, the natural spring tendencies of the wire returns the open loop portion 50*b* to its original position to retain the neck 28.

A third vertical member 46 is connected to the cross members 41 through 43. The vertical member 46 has a loop portion 46*a* which extends generally 90 degrees from the vertical member 46. The loop portion 46*a* is sized to be positioned around a portion of the housing of an aspirator. The end of the loop portion 46*a* may be formed outward to allow for positioning of the aspirator. Then, the natural spring tendency of the wire returns the open loop portion 46*a* to its original position to retain the aspirator, as will be discussed more fully hereafter.

The aspirator 80 may be any suitable aspirator such as a Model Hydrogap Air gap Eductor supplied by Hydro Systems, Inc. The aspirator 80 has an outlet end 80*a* which is in fluid communication with an outlet conduit 70. An inlet 80*b* is in fluid communication with a connector 82 which is in turn in fluid communication with an adapter 90. The adapter 90 has a first end 90*a* which is connected to the connector 82. A second end 90*b* is in fluid communication with an inlet conduit 95. The aspirator 80 also has a pickup tube end 80*c* which is fitted with a barbed fitting to connect to a pickup tube 30. The pickup tube 30 has its other end connected to a spigot 29*a* formed in the cap 29. Inside of the aspirator 80 is a venturi which is utilized to dispense the liquid inside of the container 20, as will be described more fully hereafter.

The connector 82 has a lip 82*a* which is engaged by the loop section 46*a* and is supported thereby.

The wire rack is formed of a suitable diameter wire, such as approximately ¼ inch diameter. The wire is then vinyl coated. However, it is understood that other suitable constructions may be utilized. In fact, it is envisioned that the rack could take many different forms as long as it provided the functions of being able to be mounted to a wall or the like, have a support for the container 20 and the aspirator 80.

Figure 10:
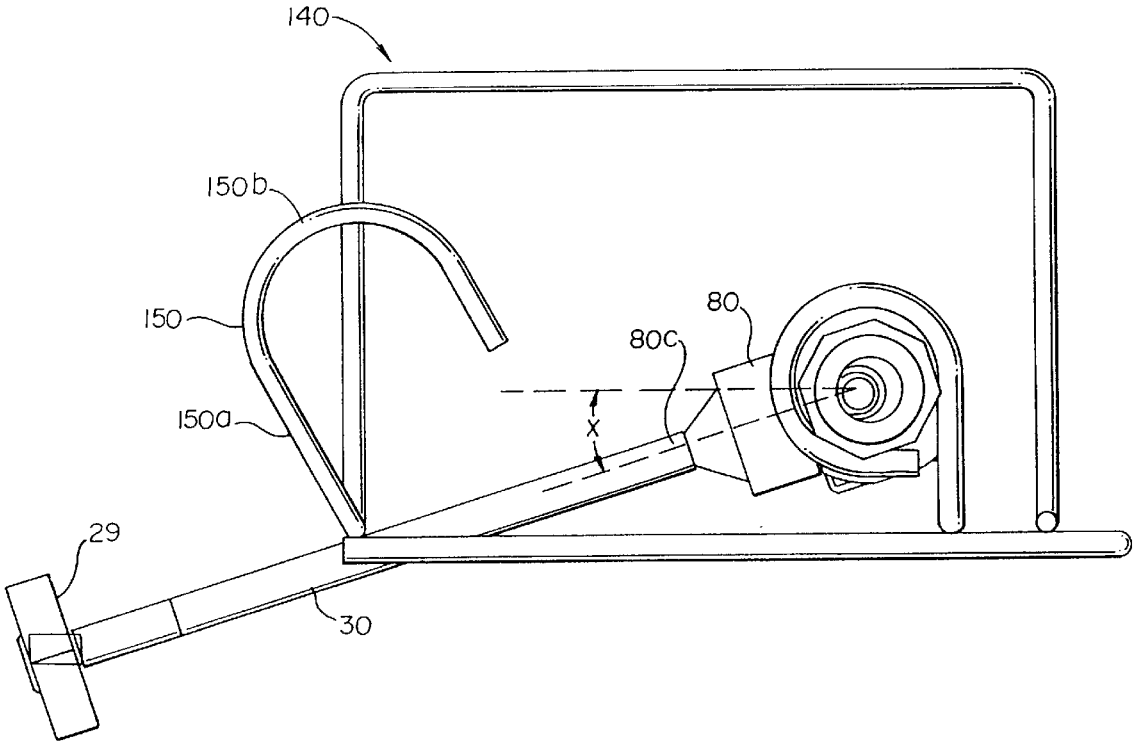
FIG. 10 is a top plan view of a second embodiment of the present invention.

A second embodiment of a wire rack is generally designated at 140 and is shown in FIG. 10. The rack 140 is very similar to the rack 40 and accordingly only the differences will be described hereinafter. The neck-engaging member 150 serves the same function as the neck-engaging member 50. The member 150 has a generally straight section 150*a* connected to an open loop portion 150*b*. The open loop portion 150*b* is sized to be positioned around the threaded neck of a container. As can be seen in comparing the second embodiment to the first embodiment, the neck-engaging member 150 is displaced further from the center of the wire rack 140 than is the loop member 50*b* on the wire rack 40. The section 150*a* extends at an angle, so as to position the loop portion 150*b* further from the aspirator. This second embodiment would be utilized where a more elongate container is utilized than in the first embodiment.

The aspirator 80, as shown in FIG. 10, is oriented at an angle with respect to the cross members of the wire rack 140. This is shown as angle X in FIG. 10. Angle X is approximately 17°. It is of course understood that other suitable angles may be utilized which still yield the benefit of not having a kinked or bent pickup tube. By orienting the pickup tube end 80*c* at this angle, the pickup tube 30 is not crimped when the cap 29 is connected to the container 20. This allows for a more natural bending of the pickup tube 30 as it increases in elevation from the aspirator to the container opening.

In operation, the wire rack 40 is secured to a wall 60 or the like by screws 99 and washers 98. The airgap dispenser 80 is placed through the loop portion 46*a* and is supported by the connector lip 82*a*. The inlet conduit 95 is connected to a suitable source of water and the outlet conduit 70 has its end connected to the point of delivery of the diluted chemical solution.

The container 20, containing the liquid to be dispensed, is positioned in the wire rack 40 and supported by the bottom supports 47,48. The neck-engaging member 50 is then positioned around the neck of the container 20. At this time, a transportation cap (not shown) is removed and the cap 29 with spigot 29*a* is threaded on the threaded neck 28. A dip tube 29*b* is connected to the spigot 29*a* and extends to the bottom of the container. A lockout device may be utilized with the cap 29. When it is desired to dispense liquid from the container 20, water is allowed to run through the conduit 95 into the aspirator 80. There, the venturi of the aspirator draws the liquid from the container 20 and mixes it with the water and the diluted liquid chemical solution is dispensed through the outlet conduit 70. It is well known in the art to utilize such aspirator type dispensers to deliver a diluted chemical solution. However, a typical prior art dispenser would utilize a cover to hide from view the aspirator. One would only see the inlet and outlet conduits in and out of the prior art dispensers. The present invention eliminates the need for a cover and utilizes the container 20 as both a container for the liquid to be dispensed as well as providing an aesthetically pleasing cover. The container 20 ha:; an indentation formed by its rear wall 24 by having the sides extend, in a concave fashion, around the aspirator 80, thereby hiding it from view, when viewed from the sides. The front portion of the container hides it from view when viewed from the front. The aspirator 80 is positioned in the indentation.

However, it can be seen that the two sides do not extend equally around the aspirator 80. Applicants have found that it is somewhat difficult to blow mold a container 20 and still maintain a thinner body profile of the container 20 Therefore, the one side does not extend as far around the aspirator and only hides it from view partially. However, one of the sides does extend far enough to hide it from view. That is, in viewing FIG. 8, the distance D3 represents the distance from the front wall 21 to the back of the side wall 22. The distance from the front wall to the back of the aspirator 80 is represented as a distance D4. The distance from the front wall to the back of the loop section 46*a* is represented as D5. Preferably, the distance D3 is greater than the distance D4 so as to hide the aspirator from view. Still more preferred is that the distance D3 be larger than the distance D5 to hide from view also the loop section 46*a*.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A liquid dispenser for attachment to a wall or the like for dispensing a liquid, the dispenser comprising:

a) a wire rack for mounting on a wall;

b) an aspirator mounted on the wire rack, the aspirator having an inlet, outlet and a pickup tube opening;

c) a pickup tube, the tube having a first end operatively connected to the aspirator and a second end;

d) a container having an outlet, the outlet operatively connected to the second end of the pickup tube, the container mounted on the wire rack; and e) the container having an outer wall and an inner wall, the inner wall positioned toward the wall, the inner wall having an indentation, the aspirator is positioned in the indentation to hide it from view.

2. The dispenser of claim 1, wherein the bottle is blow-molded and made of high-density polyethylene.

3. The dispenser of claim 1, wherein the wire rack is formed from vinyl coated wire.

4. The dispenser of claim 1, wherein the wire rack comprises:

a) two vertical members operatively connected by at least one cross member;

b) an aspirator support member having a first portion operatively connected to one of the members and a second portion forming a support section for supporting the aspirator; and c) a bottom support member having a first portion operatively connected to one of the members and a second portion for supporting the container.

5. The dispenser of claim 4, further comprising the container having a neck.

6. The dispenser of claim 5, wherein the wire rack has a neck-engaging member, the neck-engaging member having a first portion operatively connected to one of the members and a second portion for engaging the neck of the container.

7. The dispenser of claim 6, further comprising attachment segments formed in the members, the segments adapted to receive fasteners to secure the wire rack to the wall or the like.

8. The dispenser of claim 7, further comprising an inlet hose having a first end operatively connected to the inlet of the aspirator and a second end adapted to be connected to a source of pressurized water and an outlet hose having a first end operatively connected to the outlet of the aspirator, the outlet hose carrying the liquid and water solution to be dispensed.

9. The dispenser of claim 1, further comprising the aspirator being positioned at an angle with respect to a longitudinal axis of the wire rack, wherein the pickup tube is less likely to be bent when attached to the container.

10. A liquid dispenser for attachment to a wall or the like for dispensing a liquid, the dispenser comprising:

a) a frame for mounting on a wall;

b) an aspirator releasably connected to the frame, the aspirator having an inlet, outlet and a pickup tube opening;

c) a pickup tube, the tube having a first end operatively connected to the aspirator and a second end;

d) a container having an outlet, the outlet operatively connected to the second end of the pickup tube, the container mounted on the frame; and e) the container having an outer wall and an inner wall, the inner wall positioned toward the wall, the inner wall having an indentation, the aspirator is positioned in the indentation, wherein the container functions as both a reservoir for the liquid and a cover for the dispenser.

11. The dispenser of claim 10, wherein the bottle is blow-molded and made of high-density polyethylene.

12. The dispenser of claim 11, further comprising an inlet hose having a first end operatively connected to the inlet of the aspirator and a second end adapted to be connected to a source of pressurized water and an outlet hose having a first end operatively connected to the outlet of the aspirator, the outlet hose carrying the liquid and water solution to be dispensed.

13. The dispenser of claim 10 further comprising the aspirator being positioned at an angle with respect to a longitudinal axis of the wire rack, wherein the pickup tube is less likely to be bent when attached to the container.

14. A liquid dispenser for attachment to a wall or the like for dispensing a liquid, the dispenser comprising:

a) a frame for mounting on a wall;

b) an aspirator releasably connected to the frame, the aspirator having an inlet, outlet and a pickup tube opening, the aspirator having a distal edge;

c) a pickup tube, the tube having a first end operatively connected to the aspirator and a second end;

d) a container having an outlet, the outlet operatively connected to the second end of the pickup tube, the container mounted on the frame; and e) the container having a front wall operatively connected to a rear wall by a side wall, the aspirator is positioned proximate the positioning section, wherein a distance from the front wall to the side wall's end is greater than the distance from the front wall to the distal edge of the aspirator.

15. The dispenser of claim 14, wherein the bottle is blow-molded and made of high-density polyethylene.

16. The dispenser of claim 15, further comprising an inlet hose having a first end operatively connected to the inlet of the aspirator and a second end adapted to be connected to a source of pressurized water and an outlet hose having a first end operatively connected to the outlet of the aspirator, the outlet hose carrying the liquid and water solution to be dispensed.

17. The dispenser of claim 14, further comprising the aspirator being positioned at an angle with respect to a longitudinal axis of the wire rack, wherein the pickup tube is less likely to be bent when attached to the container.

* * * * *